US006677285B1

(12) United States Patent
Dudley

(10) Patent No.: US 6,677,285 B1
(45) Date of Patent: Jan. 13, 2004

(54) AEROSOL UV DYE CLEANER

(75) Inventor: Newton Howard Dudley, Blum, TX (US)

(73) Assignee: Technical Chemical Company, Cleburne, TX (US)

( * ) Notice: Subject to any disclaimer, the term of this patent is extended or adjusted under 35 U.S.C. 154(b) by 0 days.

(21) Appl. No.: 10/375,805

(22) Filed: Feb. 27, 2003

(51) Int. Cl.[7] ..... C11D 3/44

(52) U.S. Cl. ..... 510/174; 510/201; 510/365; 510/407; 510/417; 510/506; 134/38; 134/39; 134/40

(58) Field of Search ..... 134/38, 39, 40; 510/201, 365, 407, 417, 506, 174

(56) References Cited

U.S. PATENT DOCUMENTS 3,939,090 A * 2/1976 Zmoda ..... 510/182
4,606,842 A * 8/1986 Keyes et al. ..... 510/182
4,965,063 A * 10/1990 Casey et al. ..... 510/100
5,415,811 A * 5/1995 Wile et al. ..... 510/432
6,070,454 A 6/2000 Cavestri
6,293,138 B1 9/2001 Konieczney et al.
6,469,300 B1 10/2002 Trigiani et al.

* cited by examiner

*Primary Examiner*—Gregory Webb
(74) *Attorney, Agent, or Firm*—Marlin R. Smith, Esq.; J. Richard Konneker, Esq.; Konneker & Smith, P.C.

(57) ABSTRACT

An aerosol UV dye cleaner. In a described embodiment, an apparatus for cleaning UV dye from an air conditioning system includes a UV dye cleaner, a propellant and an aerosol can having the cleaner and the propellant pressurized therein. The apparatus is particularly useful in servicing automotive air conditioning systems in which access to system components is restricted.

4 Claims, 1 Drawing Sheet

AEROSOL UV DYE CLEANER

BACKGROUND

The present invention relates generally to products and methods used in air conditioning leak detection utilizing UV dye and, in an embodiment described herein, more particularly provides an aerosol UV dye cleaner.

It is common practice to introduce a UV dye into an air conditioning system when attempting to determine the location of a leak in the system, or to determine whether a leak exists. The UV dye will exit the air conditioning system, along with the refrigerant, at the location of the leak. By using special equipment, such as UV-enhancing light and goggles, a person is able to see where the UV dye has exited the system and, thus, determine the location of the leak.

Unfortunately, the UV dye will remain on the air conditioning system, even after the leak has been repaired. If a subsequent leak should occur, this prior UV dye will either provide a false indication of a leak, or possibly mask the presence of a new leak at the same location as the prior leak. Prior cleaners have been used to remove UV dye, but these have been inconvenient to use, or have been relatively ineffective for their purpose.

Therefore, it may be seen that there is a need for an improved UV dye cleaner.

SUMMARY

In carrying out the principles of the present invention, in accordance with an embodiment thereof, an aerosol UV dye cleaner is provided which is convenient and very effective in its use.

In one aspect of the invention, an apparatus for cleaning UV dye from an air conditioning system is provided. The apparatus includes a UV dye cleaner, a propellant and a container having the cleaner and the propellant pressurized therein.

In another aspect of the invention, the UV dye cleaner is preferably a composition including, by approximate weight, water 63.90%, ethylene glycol monobutyl ether 30.00%, propane 3.94%, n-butane 1.94%, nonylphenol ethoxylate surfactant 0.19% and aqueous ammonia 0.03%.

In yet another aspect of the invention, the propellant is preferably propane and/or n-butane.

In a further aspect of the invention, the container is an aerosol can having a valve for expelling the cleaner and propellant from the container.

These and other features, advantages, benefits and objects of the present invention will become apparent to one of ordinary skill in the art upon careful consideration of the detailed description of a representative embodiment of the invention hereinbelow and the accompanying drawing.

DETAILED DESCRIPTION

Figure 1:
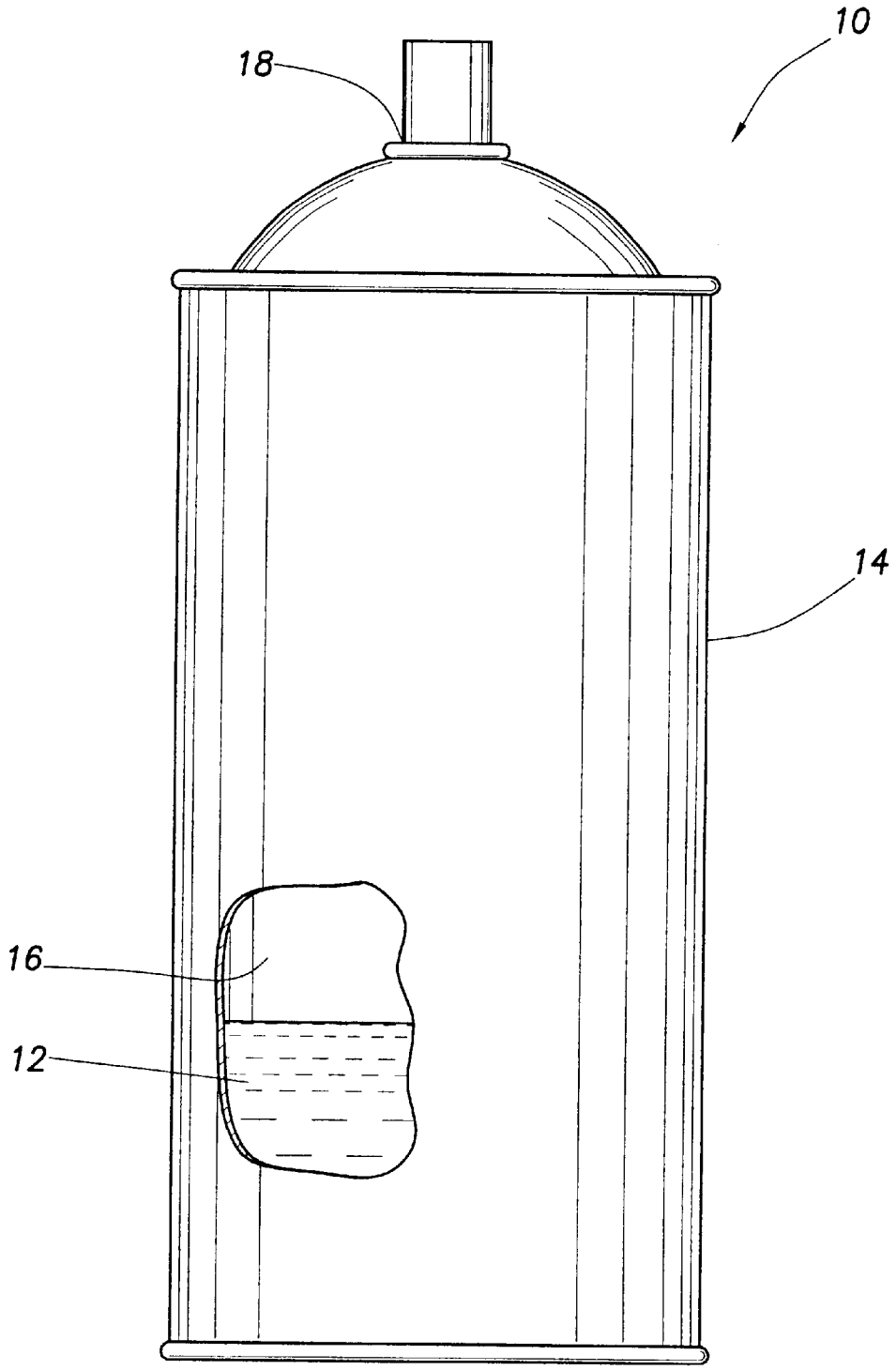
FIG. 1 is a side elevational view of an aerosol UV dye cleaner apparatus embodying principles of the present invention.

Representatively illustrated in FIG. 1 is an aerosol UV dye cleaner apparatus 10 which embodies principles of the present invention. In the following description of the apparatus 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The cleaner apparatus 10 includes a UV dye cleaner composition 12 contained within a pressurized container and dispenser 14, such as a standard aerosol can. The composition 12 is preferably made up of the following components, listed along with their approximate percentages by weight:

water 67.89% ethylene glycol monobutyl ether 31.87% nonylphenol ethoxylate surfactant 0.20% aqueous ammonia 0.03%

The composition 12 has been found to be very effective in removing UV dye from air conditioning systems, without the need for manual scrubbing of the area on which the dye has been deposited. This is very helpful in situations in which the area on which the dye has been deposited is relatively inaccessible, such as the restricted confines surrounding an automotive air conditioning system.

The composition 12 is also non-toxic, biodegradable and safe for use on air conditioning system materials. The aqueous ammonia serves as a corrosion inhibitor for the container 14, in the event that it is made of metal.

Also disposed within the container 14 is a propellant 16, which may be at least partially liquid when pressurized in the container. The propellant 16 is used to pressurize the composition 12, so that it is expelled from the container 14 when desired, such as when a valve 18 of the container is opened. Preferably, the propellant 16 is propane and/or n-butane, although other propellants may be used in keeping with the principles of the invention.

The propellant 16 delivers the cleaner composition 12 to the area on which the dye has been deposited. This is particularly useful in situations such as those described above, in which access to the area on which the dye has been deposited is restricted. Thus, a user does not have to pour the composition 12 on the area, or be able to reach the area with a manual cleaning device, each of which increases the chance that the cleaner will come into contact with the user's skin, or waste the cleaner.

A preferred cleaner composition 12 is given below, with the propane and n-butane propellants 16 included in the approximate weight percentages of the components:

water 63.90% ethylene glycol monobutyl ether 30.00% propane 3.94% n-butane 1.94% nonylphenol ethoxylate surfactant 0.19% aqueous ammonia 0.03%

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. Apparatus for cleaning UV dye from an air conditioning system, comprising:

a UV dye cleaner including, by approximate weight, water 67.89%, ethylene glycol monobutyl ether 31.87% nonylphenol ethoxylate surfactant 0.20%, and aqueous ammonia 0.03%;

a propellant; and a container having the cleaner and the propellant pressurized therein.

2. The apparatus according to claim 1, wherein the propellant includes a selected one or more of propane and n-butane.

3. The apparatus according to claim 1, wherein the container is an aerosol can having a valve for expelling the cleaner and propellant from the container.

4. Apparatus for cleaning UV dye from an air conditioning system, comprising:

a UV dye cleaner including, by approximate weight, water 67.89%, ethylene glycol monobutyl ether 31.87%, nonylphenol ethoxylate surfactant 0.20%, and aqueous ammonia 0.03%;

propellant including propane and n-butane; and an aerosol can having the cleaner and the propellant pressurized therein, and the can having a valve for expelling the cleaner and propellant from the can.

* * * * *